US011766697B2

(12) United States Patent
Halladin et al.

(10) Patent No.: US 11,766,697 B2
(45) Date of Patent: Sep. 26, 2023

(54) SCREENING MACHINE HAVING SCREENING ELEMENTS ARRANGED IN SUCCESSION

(71) Applicant: SPALECK GMBH & CO. KOMMANDITGESELLSCHAFT, Bocholt (DE)

(72) Inventors: Jörg Halladin, Bocholt (DE); Simon Schmeink, Bocholt (DE)

(73) Assignee: SPALECK GMBH & CO. KOMMANDITGESELLSCHAFT, Bocholt (DE)

( * ) Notice: Subject to any disclaimer, the term of this patent is extended or adjusted under 35 U.S.C. 154(b) by 127 days.

(21) Appl. No.: 17/424,118

(22) PCT Filed: Jan. 28, 2020

(86) PCT No.: PCT/EP2020/025033
§ 371 (c)(1),
(2) Date: Jul. 19, 2021

(87) PCT Pub. No.: WO2020/156756
PCT Pub. Date: Aug. 6, 2020

(65) Prior Publication Data

US 2022/0097100 A1 Mar. 31, 2022

(30) Foreign Application Priority Data

Jan. 31, 2019 (DE) ..... 102019102428.5

(51) Int. Cl.
*B07B 1/46* (2006.01)
*B07B 1/00* (2006.01)
(Continued)

(52) U.S. Cl.
CPC ..... *B07B 1/46* (2013.01); *B07B 1/005* (2013.01); *B07B 1/284* (2013.01); *B07B 1/34* (2013.01);
(Continued)

(58) Field of Classification Search
CPC B07B 1/005; B07B 1/46; B07B 1/284; B07B 1/34; B07B 2201/02; B07B 2201/04
(Continued)

(56) References Cited

U.S. PATENT DOCUMENTS 7,147,109 B2 12/2006 Stichert et al.
2006/0186239 A1 8/2006 Koontz
(Continued)

FOREIGN PATENT DOCUMENTS

CN 102500547 A * 6/2012 ..... B07B 1/40
CN 102500547 A 6/2012
(Continued)

OTHER PUBLICATIONS

International Search Report; priority document.

*Primary Examiner* — Terrell H Matthews
(74) *Attorney, Agent, or Firm* — Greer, Burns & Crain, Ltd.

(57) ABSTRACT

A screening machine having a machine frame that is mounted so as to be capable of vibration and is capable of being set into vibration, and having screening elements configured in a row in or on the machine frame, seen in the longitudinal direction of the screening machine. The screening machine is subdivided into a plurality of screening machine parts that are connectable or capable of being assembled to form the screening machine. An individual screening machine part or one or more stacks of a plurality of screening machine parts stacked one over the other have dimensions that are smaller in their length, width, and height
(Continued)

than the corresponding dimensions of the interior of a commonly used standard transport container or than dimensions requiring special transport due to excess size.

6 Claims, 3 Drawing Sheets

(51) Int. Cl.
*B07B 1/28* (2006.01)
*B07B 1/34* (2006.01)

(52) U.S. Cl.
CPC ..... *B07B 2201/02* (2013.01); *B07B 2201/04* (2013.01)

(58) Field of Classification Search
USPC ..... 209/233
See application file for complete search history.

(56) References Cited

U.S. PATENT DOCUMENTS

| | | | | |
|---|---|---|---|---|
| 2014/0086706 | A1 | 3/2014 | Lane et al. | |
| 2022/0097100 | A1* | 3/2022 | Halladin | B07B 1/46 |

FOREIGN PATENT DOCUMENTS

| | | | | | |
|---|---|---|---|---|---|
| CN | 104520021 | A | * | 4/2015 | B01D 25/00 |
| CN | 108136443 | A | * | 6/2018 | B07B 1/28 |
| DE | 8512051 | U1 | | 8/1985 | |
| DE | 29780442 | U1 | | 2/1999 | |
| DE | 29915236 | U1 | | 1/2001 | |
| DE | 10134871 | A1 | | 2/2003 | |
| DE | 102012206347 | A1 | * | 10/2013 | B07B 1/485 |
| DE | 102012206347 | A1 | | 10/2013 | |
| EP | 2987564 | A1 | * | 2/2016 | B07B 1/18 |
| EP | 2987564 | A1 | | 2/2016 | |
| WO | 9833604 | | | 8/1998 | |
| WO | 2009029962 | A1 | | 3/2009 | |
| WO | WO-2009029962 | A1 | * | 3/2009 | B07B 1/42 |

* cited by examiner

SCREENING MACHINE HAVING SCREENING ELEMENTS ARRANGED IN SUCCESSION

CROSS-REFERENCES TO RELATED APPLICATIONS

This application claims the benefit of the International Application No. PCT/EP2020/025033, filed on Jan. 28, 2020, and of the German patent application No. 102019102428.5 filed on Jan. 31, 2019, the entire disclosures of which are incorporated herein by way of reference.

FIELD OF THE INVENTION

The present invention relates to a screening machine having a machine frame mounted so as to be capable of vibration and capable of being set into vibration, and having screening elements configured in a row in or on the machine frame, seen in the longitudinal direction of the screening machine.

SUMMARY OF THE INVENTION

Screening machines per se have been known for decades, and are in wide use.

DE 85 12 051 U1, for example, indicates a screening device having a bearing construction that can be set into vibration that is supported on the supporting surface on springs, and has a vibration exciter. The bearing construction is made up of two side walls connected by first crossbeams, which walls preferably carry out a circular vibration, as well as second crossbeams that are connected to the bearing construction by springs and that vibrate elliptically or in the longitudinal direction, and an elastic screening mat being situated between each first and second crossbeam. The vibrating device can be set up having an inclination, so that an adequate conveying speed and a corresponding dwell time of the screening material on the screen is achieved.

DE 10 2012 206 347 A1 shows a screening device having a base frame that can be set into vibration and that is made up of two side walls connected by first crossbeams, and having an additional frame connected to the base frame via spring elements, the additional frame being formed from two side beams configured parallel to the side walls and connected by second crossbeams, the first and second crossbeams alternating with one another, seen in the longitudinal direction of the screening device, and flexible screening mats, forming a screening surface, being clamped between each first and second crossbeam, and the additional frame being divided into at least two additional frame segments in the longitudinal direction. In addition, it is provided that the screening device, seen in its longitudinal direction, has at least two screening segments, situated one after the other, having different orientations relative to the horizontal, that each screening segment is assigned its own additional frame segment, and that each screening segment, in addition to the different orientation relative to the horizontal, differs from the other screening segment or segments in at least one further screening parameter. This is also a unified screening machine in which it is merely the case that screening machine regions having different inclinations are provided.

The desire for a particularly cost-effective operation of screening machines by means of large throughput quantities has the result that increasingly larger screening machines are demanded and built. The increasing size of screening machines however also results in increasing transport problems. Large screening machines require the construction of specially adapted individual transport devices and underframes made of wood and/or metal in order to enable the screening machines to be transported on transport means such as flat rack containers or flat bed trucks. Because these are open transport means, the screening machines, in particular during ocean transport, have to be additionally packaged in order to protect them from damaging external influences. This results in a larger outlay and correspondingly high costs. Theoretically, it would be possible to transport a screening machine completely broken down into its individual parts, but here the problem remains that the screening machine has individual parts that are still so large that specially adapted individual transport devices would have to be manufactured for this purpose.

SUMMARY OF THE INVENTION

Therefore, for the present invention the object arises of providing a screening machine of the type named above that avoids the mentioned disadvantages of the prior art, and that, in particular, can be transported more easily and at lower cost.

According to the present invention, this object is achieved by a screening machine of the type named above that is characterized in that the screening machine is subdivided into a plurality of screening machine parts that can be connected or that can be assembled to form the screening machine, and that an individual screening machine part, or one or more stacks of a plurality of screening machine parts stacked one over the other, have dimensions of length, width, and height that are smaller than the corresponding dimensions of the interior space of a commonly used standard transport container, or than dimensions requiring special transport due to excess size.

The screening machine according to the present invention is thus designed and optimized for transport in box containers and open-top containers, and on standard transport vehicles not having oversized load dimensions. This is achieved in that the individual screening machine parts are produced with external dimensions such that they can be housed, individually or in groups, in box containers and open-top containers and on standard transport vehicles not having oversized load dimensions. In this way, a substantially reduced outlay is achieved for transport and packaging, through the omission of complicated individual transport constructions made of wood and/or metal. Moreover, there results a substantially lower financial outlay for the transport, because commonly used standardized box containers and open-top containers can be shipped by truck, railway, and ship at lower costs.

The component of a screening machine having the largest extension is usually the machine frame of the screening machine, in particular, in the form of two side walls. Therefore, in a further embodiment of the present invention it is provided that the machine frame, seen in the machine frame longitudinal direction, is divided into a plurality of sub-frames that can be connected or assembled to form the machine frame, and that at least one of the screening elements is assigned to each sub-frame, and that a single sub-frame with screening element, or one or more stacks of a plurality of sub-frames stacked one over the other, each having a screening element, have dimensions of length, width, and height that are smaller than the corresponding dimensions of the interior of a commonly used standard transport container, or than dimensions requiring special transport due to excess size.

In order to enable the screening machine to be set up as quickly and easily as possible at its location of use, it is provided that separate resilient support elements are allocated to each screening machine part or sub-frame.

For the same reason, it is preferably provided that at least one separate vibratory drive is allocated to each screening machine part or sub-frame.

Depending on the intended use of the screening machine, the connections between adjacent screening machine parts or sub-frames can be rigid or resilient connections.

In order to achieve a configuration of the screening machine that is compact, in particular, as short as possible, it is provided that adjacent screening machine parts or sub-frames are connectable to one another, or can be assembled, in a vicinity to one another that permits a direct transfer of screening material without additional transfer means. In such a configuration, separate screening material transfer chutes between the screening machine parts are not additionally required.

In order to achieve a transport that is as safe as possible of stacked screening machine parts or sub-frames of the screening machine, each screening machine part or sub-frame preferably has upper-side and lower-side stack contours that, in the stack of a plurality of screening machine parts or sub-frames, engage with one another so as to prevent a transverse displacement of the screening machine parts or sub-frames relative to one another. The stack contours improve the positional securing in the container or transport vehicle, and substantially contribute to preventing damage to the screening machine parts or sub-frames during transport.

The screening machine according to the present invention advantageously permits an advantageous modular design, for which purpose in the ideal case all screening machine parts or sub-frames are made identical to one another. The modular design contributes to a particularly low-cost manufacture and assembly of the screening machine.

In a somewhat less thorough realization of the modular construction of the screening machine, apart from the first and last screening machine part or subframe, seen in the direction of conveyance of the screening material, the further screening machine parts or sub-frames can be made identical to one another. Here, the fact is taken into account that, in practice, particular designs or special components often have to be provided at the beginning and at the end of a screening machine.

Finally, for the screening machine according to the present invention, it is specifically also provided that an individual screening machine part, or a stack of a plurality of screening machine parts stacked one over the other, or an individual sub-frame having a screening element, or a stack of a plurality of sub-frames stacked one over the other each having a screening element, has a maximum length between 2.1 m and 2.5 m, a maximum width between 2.1 m and 16.0 m, and a maximum height between 1.95 m and 2.7 m. At 2.1 m, the named length dimension corresponds to the door opening of a standardized eight-foot container, and, at 2.5 m, to the maximum loading width for roadway transport without special permits. The named width dimensions, at 2.1 m, correspond to the inner length of a closed, standardized eight-foot container, and, at 16.0 m, to the length of a standardized 53-foot container. The named height dimensions correspond, at 1.95 m, to the door height of a standardized closed eight-foot container, and at 2.7 m to the height of a standardized open-top container.

BRIEF DESCRIPTION OF THE DRAWINGS

In the following, exemplary embodiments of the present invention are explained on the basis of a drawing.

In the following description of the Figures, identical parts in the various Figures are always provided with the same reference characters, so that all reference characters do not have to be explained again for each Figure.

DETAILED DESCRIPTION OF THE PREFERRED EMBODIMENTS

Figure 2:
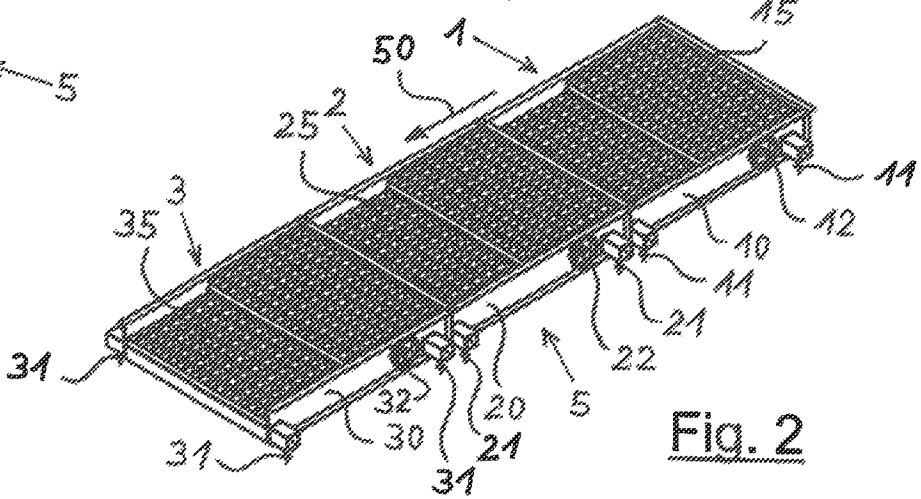
FIG. 2 shows a part of a second screening machine, in an oblique view from above.
Figure 1:
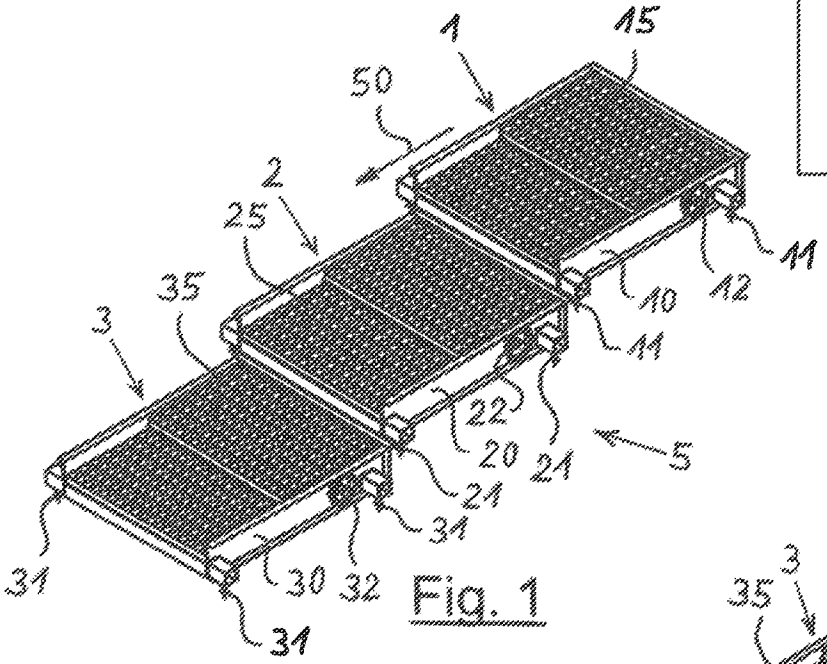
FIG. 1 shows a part of a first screening machine, in an oblique view from above.

FIGS. 1 and 2 show part of a first and of a second screening machine 5, in an oblique view from above, screening machine 5 here comprising three screening machine parts 1, 2, 3 configured in a row. Here, in the exemplary embodiment of FIG. 1, screening machine parts 1, 2, 3 descend in stepped fashion in screening material conveying direction 50, and, in the exemplary embodiment of FIG. 1, are situated in a common plane.

In their further features, described in the following, the exemplary embodiments of FIGS. 1 and 2 agree with each other.

Each screening machine part 1, 2, 3 has a respective sub-frame 10, 20, 30, each surrounding and bearing an associated, here two-part, screening element 15, 25, 35. On the lower side of each of two oppositely situated longitudinal sides of sub-frames 10, 20, 30, there is situated, in each case, a pair of resilient support elements 11, 21, 31, formed, for example, by steel springs or elastomer springs or pneumatic springs. With their lower end, support elements 11, 21, 31, in the completed state of screening machine 5, are connected with the side walls thereof (not shown here for clarity). The side walls, if required, are also subdivided into smaller side wall parts that are connectable to one another to form the complete side walls, e.g., by screw connections. Here, the side wall parts can also respectively form a constructive unit with screening machine parts 1, 2, 3 or sub-frames 10, 20, 30, the unit being preassembled before a transport.

At least one separate vibratory drive 12, 22, 32, e.g., having a rotating imbalance mass, is allocated to each screening machine part 1, 2, 3 or sub-frame 10, 20, 30. For reasons of symmetry, it is expedient to provide a respective vibratory drive 12, 22, 32 on each longitudinal side of each screening machine part 1, 2, 3; however, in FIGS. 1 and 2 the vibratory drives, situated in each case on the rear longitudinal side, are not visible.

Connections between adjacent screening machine parts 1, 2, 3 or sub-frames 10, 20, 30 may be realized as rigid or as resilient connections. Screening machine parts 1, 2, 3 or sub-frames 10, 20, 30 can also be configured so as not to be connected to one another, because they are still mounted on the side walls (not shown) of screening machine 5 via resilient support elements 11, 21, 31.

In addition, FIGS. 1 and 2 show that the adjacent screening machine parts 1, 2, 3 or sub-frames 10, 20, 30 are connected to one another, or assembled, in a vicinity to one another that permits a direct transfer of screening material without additional transfer means. If larger distances exist between screening machine parts 1, 2, 3 or sub-frames 10, 20, 30, additional screening material transfer chutes may be provided in order to bridge these distances.

As described above, a plurality of screening machine parts 1, 2, 3, connectable or capable of being assembled to form screening machine 5, are provided. According to FIG. 3, this subdivision is carried out, depending on the size of screening machine 5, in such a way that an individual screening machine part 1, 2, 3, or one or more stacks 4 of a plurality of screening machine parts 1, 2, 3 stacked one over the other, have dimensions of length, width, and height that are smaller than the corresponding dimensions of the interior of a commonly used standard transport container 6, or than dimensions requiring special transport due to excess size.

Figure 3:
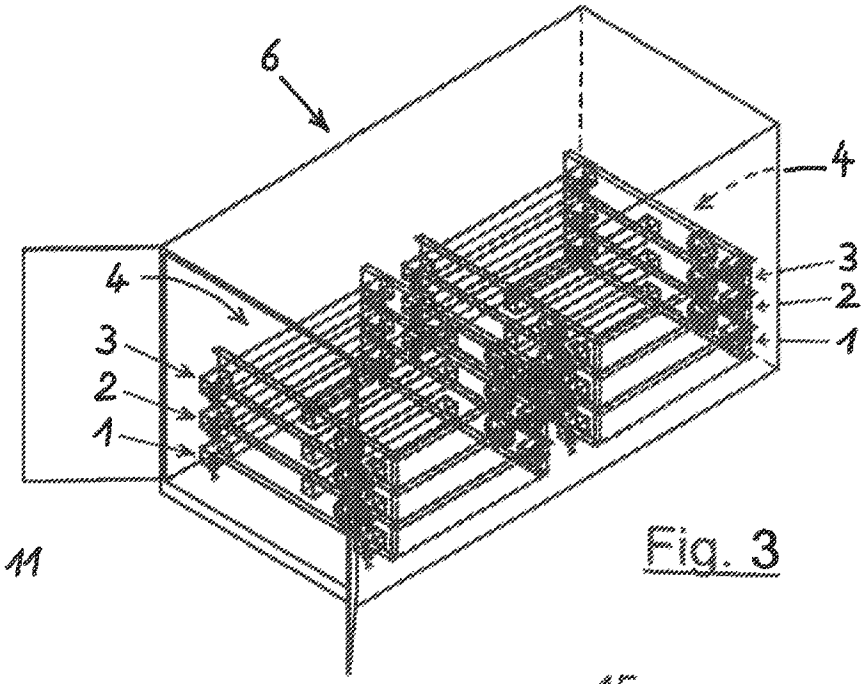
FIG. 3 shows a container having stacked screening machine parts situated therein.

In the example of FIG. 3, two stacks 4, each made up of three screening machine parts 1, 2, 3, are housed in container 6 for transport.

Figure 4:
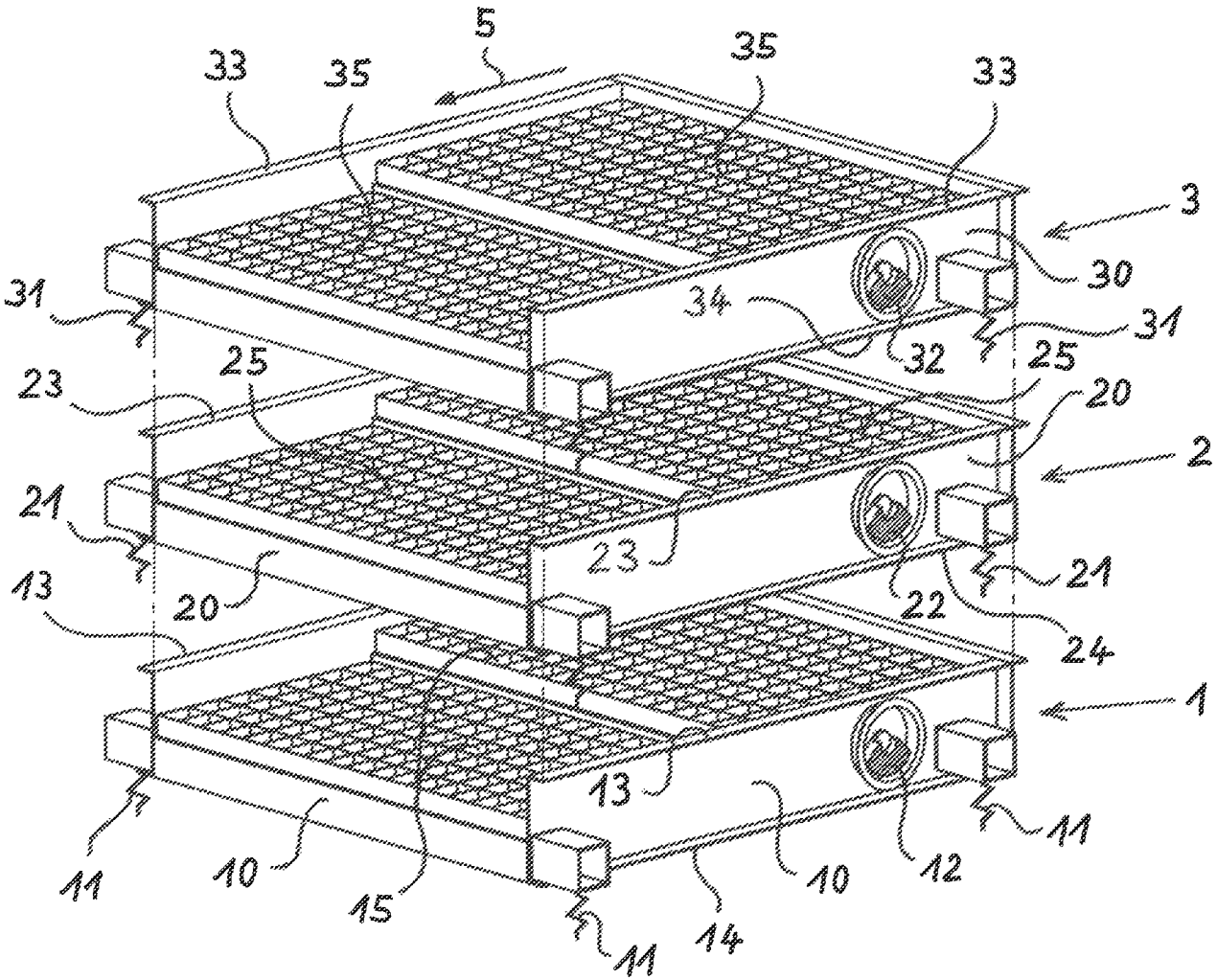
FIG. 4 shows three screening machine parts during stacking one over the other.

For the purpose of a configuration secure against sliding of screening machine parts 1, 2, 3 one over the other in stack 4, each screening machine part 1, 2, 3 or sub-frame 10, 20, 30 has, as shown in enlarged fashion in FIG. 4 during a stacking process, upper-side and lower-side stack contours 13, 14, 23, 24, 33, 34 that, in stack 4 made up of a plurality of screening machine parts 1, 2, 3 or sub-frames 10, 20, 30, engage in one another so as to prevent a transverse displacement of screening machine parts 1, 2, 3, or sub-frames 10, 20, 30 in stack 4 relative to one another.

As can be seen in particular in FIG. 4, all screening machine parts 1, 2, 3 or sub-frames 10, 20, 30 having screening elements 15, 25, 35, are realized identically to one another, which enables an advantageous modular construction of screening machine 5.

Figure 6:
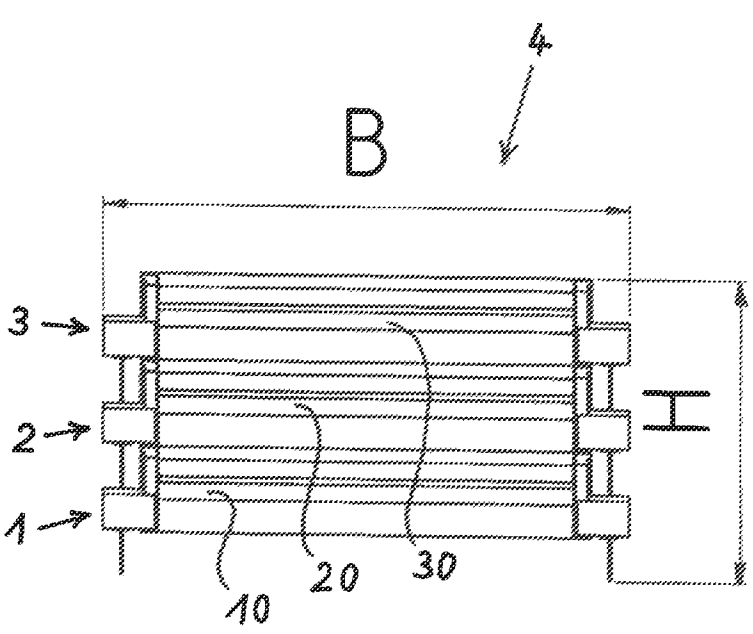
FIG. 6 shows the stack of FIG. 5 with the three screening machine parts, in a view of its end face.
Figure 5:
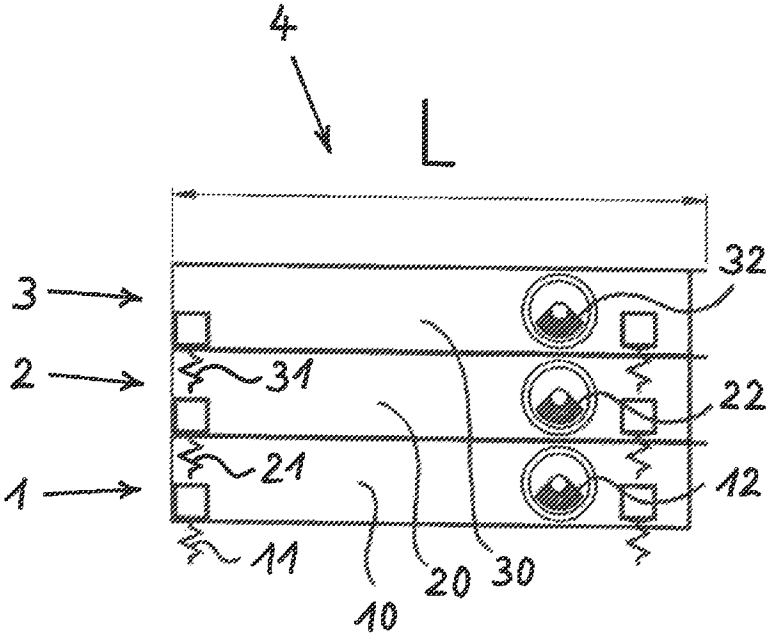
FIG. 5 shows a stack of three screening machine parts in a view of their longitudinal side.

FIG. 5 shows a stack 4 of three screening machine parts 1, 2, 3, in a view of their longitudinal side, and FIG. 6 shows stack 4 of FIG. 5 with the three screening machine parts 1, 2, 3 in a view of their end face. According to FIG. 5, screening machine parts 1, 2, 3, and thus also stack 4, have a length L, viewed in the direction of the longitudinal side. According to FIG. 6, screening machine parts 1, 2, 3, and thus also stack 4, have a width B, viewed in the end face direction, and a height H, viewed in the vertical direction. These external dimensions length L, width B, and height H, are selected such that they are smaller than the corresponding dimensions of the interior of a commonly used standardized transport container, such as those of container 6 shown in FIG. 3. At the same time, or alternatively, the external dimensions length L, width B, and height H are selected such that they are smaller than dimensions requiring special transport that would require a permit due to excess size, which is important in particular for roadway transport on a truck.

In practice, with regard to available sizes of standardized transport containers and of transport vehicles, in particular trucks, it has turned out to be advantageous if an individual screening machine part, or one or more stacks made up of a plurality of screening machine parts stacked one over the other, or an individual sub-frame with screening element, or one or more stacks of a plurality of sub-frames stacked one over the other, each having a screening element, have a maximum length between 2.1 m and 2.5 m, a maximum width between 2.1 m and 16.0 m, and a maximum height between 1.95 m and 2.7 m.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE CHARACTERS

1 first vibrating machine part
10 first sub-frame
11 resilient support elements on 1
12 vibratory drive on 1
13 upper-side stack contour on 1
14 lower-side stack contour on 1
15 screening element in 1
2 second vibrating machine part
20 second sub-frame
21 resilient support elements on 2
22 vibratory drive on 2
23 upper side stack contour on 2
24 lower side stack contour on 2
25 screening element(s) in 2
3 third vibrating machine part
30 third sub-frame
31 resilient support elements on 3
32 vibratory drive on 3
33 upper side stack contour on 3
34 lower side stack contour on 3
35 screening element(s) in 3
4 stack
5 screening machine
50 screening material conveying direction
6 container
L length of 4
B width of 4
H height of 4

The invention claimed is:

1. A screening machine comprising:

a machine frame that is mounted to be capable of vibration and is capable of being set into vibration, screening elements configured in a row in or on the machine frame, wherein the screening machine is subdivided into a plurality of screening machine parts that are connectable or capable of being assembled to form the screening machine, wherein separate resilient support elements are allocated to each screening machine part, wherein at least one separate vibratory drive is assigned to each screening machine part, wherein an individual screening machine part or one or more stacks of a plurality of screening machine parts stacked one over the other have a maximum length between 2.1 m and 2.5 m, a maximum width between 2.1 m and 16.0 m, and a maximum height between 1.95 m and 2.7 m, wherein the machine frame, seen in the machine frame longitudinal direction, is subdivided into a plurality of sub-frames connectable or capable of being assembled to form the machine frame, wherein at least one of the screening elements is allocated to each sub-frame, wherein separate resilient support elements are allocated to each sub-frame, wherein at least one separate vibratory drive is allocated to each sub-frame, and wherein an individual sub-frame having a screening element, or one or more stacks of a plurality of sub-frames stacked one over the other, having a respective screening element, have a maximum length between 2.1 m and 2.5 m, a maximum width between 2.1 m and 16.0 m, and a maximum height between 1.95 m and 2.7 m.

2. The screening machine according to claim 1, wherein the connections between adjacent sub-frames are rigid or resilient connections.

3. The screening machine according to claim 1, wherein adjacent sub-frames are connectable or capable of being assembled in a vicinity to one another that permits a direct transfer of screening material without additional transfer means.

4. The screening machine according to claim 1, wherein each sub-frame has upper-side and lower-side stack contours that, in the stack of a plurality of sub-frames, engage in one another to prevent a transverse displacement of the sub-frames relative to one another.

5. The screening machine according to claim 1, wherein all sub-frames are realized identically to one another.

6. The screening machine according to claim 1, wherein apart from a respective first and last sub-frame, seen in the screening material conveying direction, remaining sub-frames are realized identically to one another.

* * * * *